US006513285B2

(12) United States Patent
Isomura

(10) Patent No.: US 6,513,285 B2
(45) **Date of Patent: *Feb. 4, 2003**

(54) DEVICE FOR OPENING AND CLOSING A VEHICLE SLIDE DOOR WINDOW

(75) Inventor: Yukio Isomura, Chita (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/891,278

(22) Filed: Jun. 27, 2001

(65) Prior Publication Data

US 2002/0020115 A1 Feb. 21, 2002

(30) Foreign Application Priority Data

Jun. 28, 2000 (JP) ..... 2000-194793

(51) Int. Cl.[7] ..... E05F 11/44
(52) U.S. Cl. ..... 49/351; 49/360; 49/349
(58) Field of Search ..... 49/360, 348, 349, 49/350, 351; 296/155

(56) References Cited

U.S. PATENT DOCUMENTS 3,816,962 A * 6/1974 Ladd et al. ..... 49/351
4,986,029 A * 1/1991 Richter ..... 49/349
5,595,025 A * 1/1997 MacPhail-Fausey ..... 49/351
5,850,711 A * 12/1998 Takahashi et al. ..... 49/351

FOREIGN PATENT DOCUMENTS

JP 2000-145288 A 5/2000

* cited by examiner

*Primary Examiner*—Jerry Redman
(74) *Attorney, Agent, or Firm*—Burns, Doane, Swecker & Mathis, LLP

(57) ABSTRACT

A device for opening and closing a vehicle slide door window includes a window regulator mechanism having a lift arm supporting a pane and a driving mechanism for moving the pane in downward and upward directions when the driving mechanism rotates the lift arm in opposite directions to effect opening and closing of a window portion. A cam plate is arranged on the rotational axis of the lift arm and is operatively associated with the lift arm for rotating together with the lift arm and a detection lever is positioned adjacent to the cam plate and brought into contact with the cam plate at an end of the detection lever.

21 Claims, 5 Drawing Sheets

DEVICE FOR OPENING AND CLOSING A VEHICLE SLIDE DOOR WINDOW

The present application is based on and claims priority under 35 U.S.C. § 119 with respect to Japanese Patent Application No. 2000-194793 filed on Jun. 28, 2000, the entire content of which is incorporated herein by reference.

FIELD OF THE INVENTION

The present invention generally relates to vehicle windows. More particularly, the present invention pertains to a device for opening and closing a vehicle slide door window.

BACKGROUND OF THE INVENTION

An example of a device for opening and closing a vehicle slide door window is disclosed in Japanese Patent Laid-Open Publication No. 2000-145288 published on May 26, 2000 without examination. The device is provided with a window regulator mechanism and an opening condition detection mechanism. The window regulator mechanism includes a lift arm and a driving mechanism. A roller on one end of the lift arm supports a pane while the opposite end of the lift arm is connected to the driving mechanism by a sector gear of the lift arm. The driving mechanism moves the pane in the downward and upward directions when the driving mechanism rotates the lift arm in opposite directions to effect opening and closing of a window portion.

The opening condition detection mechanism includes a cam plate and a detection lever. The cam plate is secured on the lift arm and arranged between the roller of the lift arm and a rotational axis of the lift arm. The cam plate is operatively associated with the lift arm for movement together with the lift arm. The detection lever is adapted to be brought into contact with a cam surface of the cam plate. Therefore, when the lift arm rotates for opening the window portion, the detection lever is rotated by the cam plate. As the result, the detection lever detects the opening condition of the window portion.

In the above mentioned device, the cam plate is arranged away from the rotational axis of the lift arm. The cam plate is thus relatively large in size for retaining contact between the cam surface and the detection lever through the rotational scope of the lift arm.

A need thus exists for an improved device for opening and closing a vehicle slide door window.

It would be desirable to provide an opening and closing device for opening and closing a vehicle slide door window which is not as large in size.

SUMMARY OF THE INVENTION

According to the present invention, the device for opening and closing the vehicle slide door window includes a window regulator mechanism having a lift arm supporting a pane and a driving mechanism for moving the pane in downward and upward directions when the driving mechanism rotates the lift arm in opposite directions to effect opening and closing of a window portion, a cam plate arranged on the rotational axis of the lift arm and operatively associated with the lift arm for rotate together with the lift arm and a detection lever being positioned adjacent to the cam plate and brought into contact with the cam plate at an end of the detection lever.

According to another aspect of the invention, a device for opening and closing a vehicle slide door window includes a lift arm supporting a window pane, a shaft on which the lift arm is mounted for rotating about a rotational axis together with the lift arm, a driving mechanism operatively associated with the lift arm to rotate the lift arm in opposite directions and cause upward and downward movement of the window pane, and a cam member mounted on the shaft to rotate together with the shaft, with the cam member including a cam surface. A movable detection lever has a portion engaging the cam surface to move in response to rotation of the cam member, and a connecting cable is connected to the detection lever to be pulled upon rotation of the detection lever.

In accordance with another aspect of the invention, a device for opening and closing a vehicle slide door window includes a lift arm supporting a window pane, a driving mechanism operatively associated with the lift arm to rotate the lift arm about a rotational axis to raise and lower the window pane, a rotatable member rotatable about said rotational axis, and a movable detection lever engaged with the rotatable member to move in response to rotation of the rotatable member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
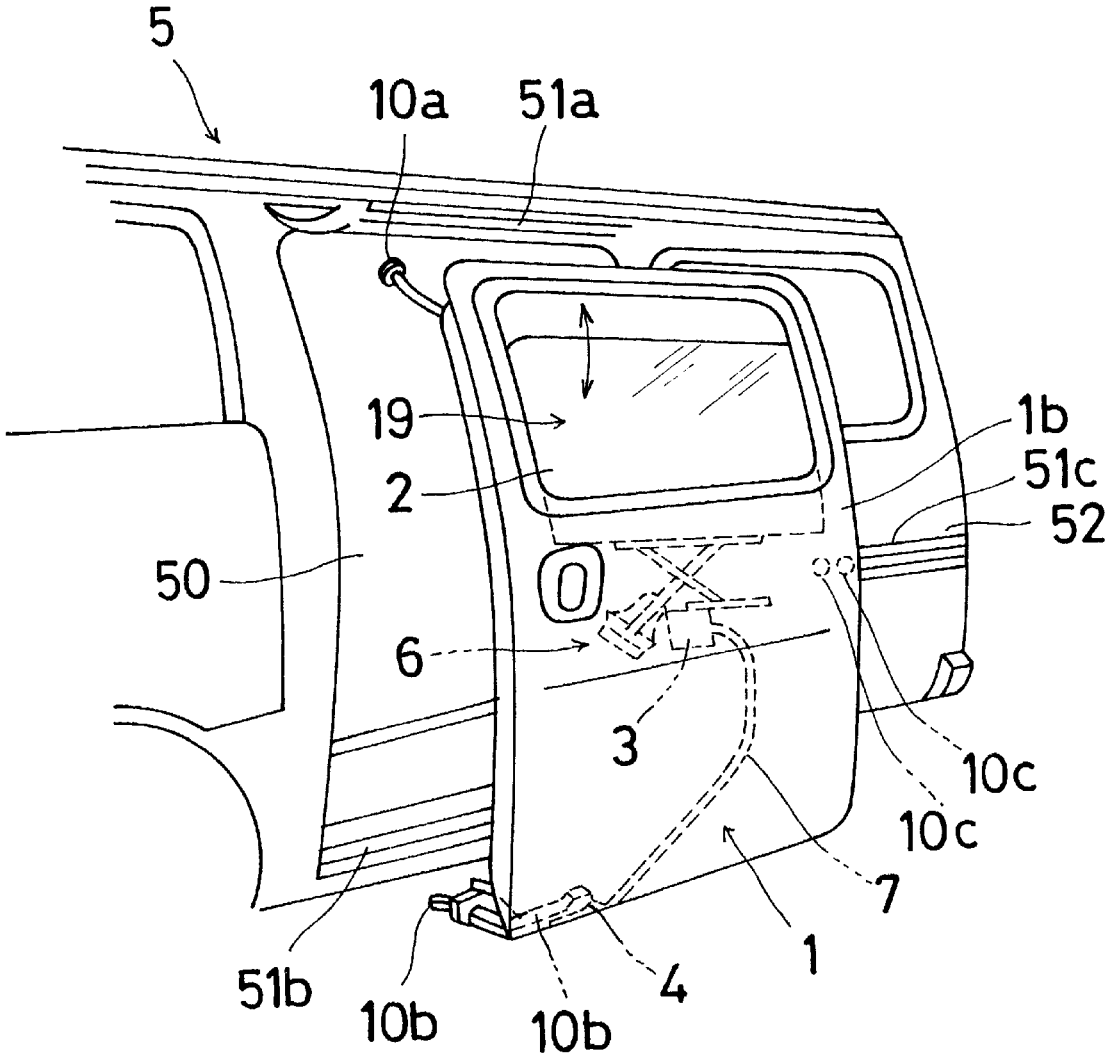
FIG. 1 is a perspective of a vehicle slide door on which is mounted a window-opening/closing device according to an embodiment of the present invention.

Referring initially to FIG. 1, which illustrates the rear portion of a van-type vehicle 5, the lateral side of the vehicle is provided with an opening 50 to permit passengers or occupants to enter and exit the vehicle 5. The opening 50 is opened and closed by a slide door 1. The upper portion of the slide door 1 is outfitted with a window portion 19 that is opened and closed by a window glass or window pane 2. The pane 2 is movable in the upward and downward directions under the driving action of a window regulator mechanism 6. The window regulator mechanism 6 is provided with an opening condition detection mechanism 3 which senses that the amount of downward displacement of the window pane 2 has reached a set value from a fully closed position (i.e., a position at which the window portion 19 is fully closed by the pane 2).

The lower portion of the slide door 1 is provided with a stopper mechanism 4 which is connected via a connecting cable 7 to the opening condition detection mechanism 3. The window regulator mechanism 6 and the opening condition detection mechanism 3 together constitute a window-opening/closing device.

The slide door 1 is slidably mounted on the lateral side of the vehicle 5 for movement in the lengthwise direction of the vehicle 5. To establish this movement, three guide roller mechanisms are provided. The guide roller mechanisms include an upper guide roller 10*a* positioned above the upper edge of the slide door 1, a pair of lower guide rollers 10*b*, 10*b* provided at the lower edge of the slide door 1, and a pair of center guide rollers 10*c*, 10*c* positioned generally at the center portion of the slide door 1 with respect to the height-wise extent of the vehicle. The body of the vehicle 5 is provided with an upper guide rail 51*a* located at the upper side of the opening 50 for guiding the upper guide roller 10*a*, a lower guide rail 51*b* located at the lower side of the opening 50 for guiding the pair of lower guide rollers 10*b*, 10*b*, and a center guide rail 51*c* located at the vehicle rear side portion 52 for guiding the pair of center guide rollers 10*c*, 10*c*.

Figure 2:
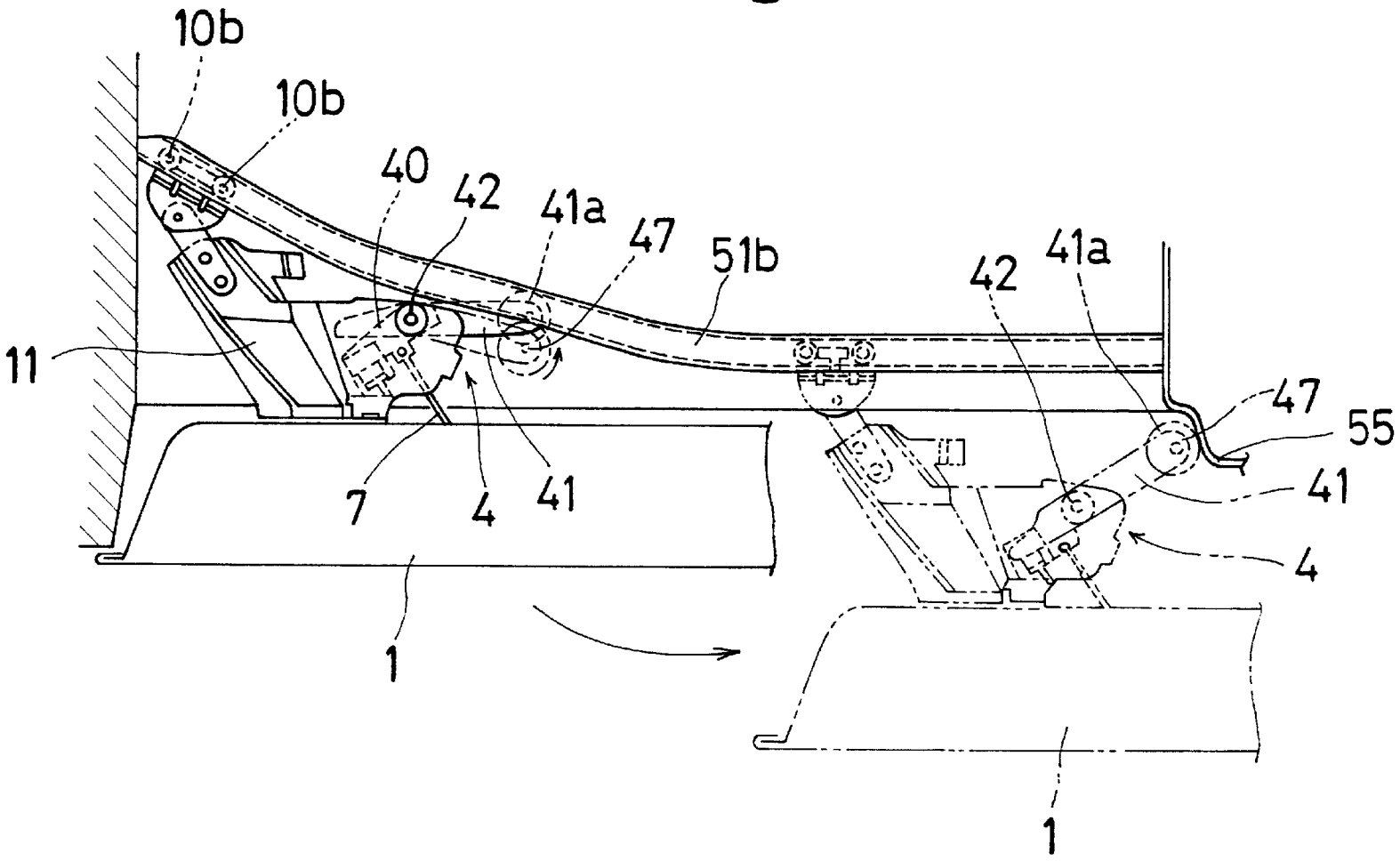
FIG. 2 is a top view of a portion of the window-opening/closing device illustrating the stopper mechanism.

As best shown in FIG. 2, the stopper mechanism 4 is mounted on a fixed bracket 11 by which the pair of lower rollers 10*b*, 10*b* is supported on the slide door 1. The stopper mechanism 4 includes a first rotation lever 40 which is connected to the connecting cable 7 and a second rotation lever 41 which is rotatable together with the first rotation lever 40.

The first rotation lever 40 and the second rotation lever 41 are pivotally connected by a common pin 42 to the fixed bracket 11 so as to be rotatable in a horizontal plane. One end portion of the second rotation lever 41 is pivoted by a shaft 47 with a roller 41*a* which is in rolling engagement with the lower guide rail 51*b*. The second rotation lever 41 is continuously urged by a spring to establish engagement between the roller 41*a* and the lower guide rail 51*b*.

With the foregoing structure, so long as the connecting cable 7 is not pulled by the opening condition detection mechanism 3, as depicted by the one-dotted line position in FIG. 2, the roller 41*a* is close to the slide door 1. Thus, even though the slide door 1 is moved in the rearward direction from its fully closed position, the roller 41*a* does not contact a wall portion 55 of the vehicle body. When the opening condition detection mechanism 3 pulls the connecting cable 7, the first rotation lever 40 and the second rotation lever 41 of the stopper mechanism 3 are rotated. The roller 41*a* is thus transferred inwardly along the vehicle body lateral direction from the one-dotted line position depicted in FIG. 2, thereby being moved away from the slide door 1 as depicted by the real line position in FIG. 2. Thus, in this situation, moving the slide door 1 in the rearward direction of the vehicle results in the roller 41*a* being brought into engagement with the wall portion 55 of the vehicle body, thus preventing further rearward movement of the slide door 1 so that the fully opened condition of the slide door 1 cannot be established.

Figure 3:
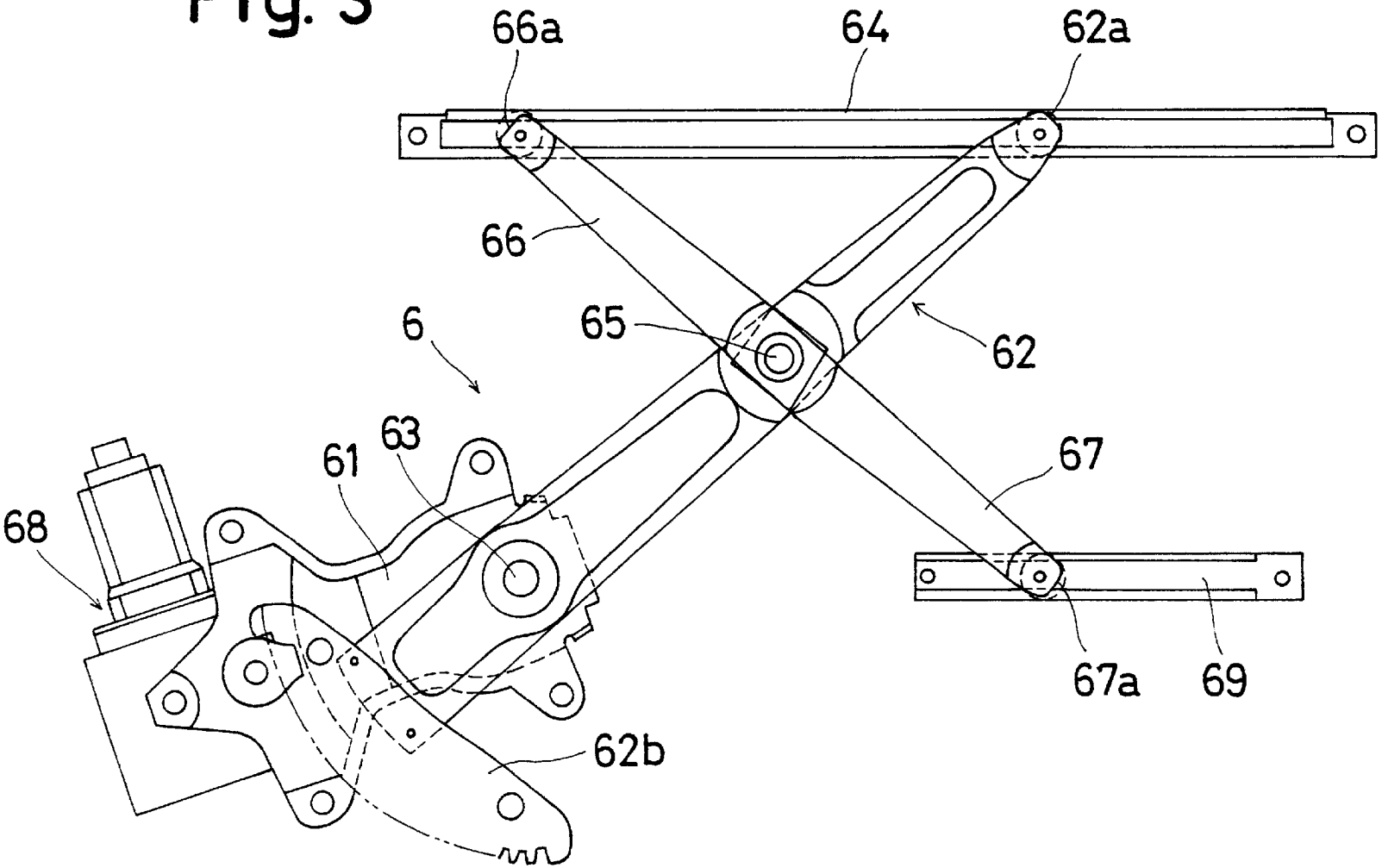
FIG. 3 is a front view of the window-opening/closing device according to the present invention.

As shown in FIG. 3, the window regulator mechanism 6 which is accommodated in the slide door 1 includes a base plate 61 connected to a panel of the slide door 1. The base plate 61 forms a unitary structure of the window regulator mechanism 6.

A lift arm 62 is rotatably supported on the base plate 61 by a rotating shaft 63. A through hole 61*a* having a flange is formed in the base plate 61, for example by a burring process. The rotating shaft 63 is rotatably supported at the base plate 61 through the through hole 61*a*. First and second fixed shaft portions 63*a*, 63*b* are formed at the ends of the rotating shaft 63, respectively. The first and second fixed shaft portions 63*a*, 63*b* have a pair of flat surfaces, respectively. The lift arm 62 is secured to the first fixed shaft portion 63*a* to rotate together with the rotating shaft 63. The rotating shaft 63 forms a rotational axis of the lift arm 62.

One end portion of the lift arm 62 is provided with a roller 62*a* which slidably engages a rail 64 connected to the lower end of the window pane 2. The lift arm 62 thus, in effect, supports the window pane 2. A pin 65 is provided at a substantially central portion of the lift arm 62. Two equalizer arms 66, 67 are also provided, with one end of each equalizer arm 66, 67 being rotatably mounted of on the pin 65. The other end of one equalizer arm 66 is provided with a roller 66*a* which slidably engages the rail 64, while the other end of the other equalizer arm 67 is provided with a roller 67*a* which slidably engages a rail 69 that is secured to the panel of the slide door 1.

A driving mechanism 68 is supported on the base plate 61. The driving mechanism 68 includes, among other known features, a motor serving as a driving source and a speed reduction gear train. The other end portion of the lift arm 62 is secured to or provided with a sector gear 62*b* which is in meshing engagement with an output pinion gear of the driving mechanism 68.

When the motor of the driving mechanism 68 is turned on, the rotation of the pinion gear which is in meshing engagement with the sector gear 62*b* causes rotation of the lift arm 62 together with the rotating pin 63 about the rotational axis of the lift arm 62 that is coincident with the rotating shaft 63. This brings about vertical movement of the window pane 2 which is guided through an up-down guide mechanism. As a result, the window portion 19 of the slide door 1 is opened. Operating the motor in the reverse direction causes upward movement or closure of the window portion 19 of the slide door 1. While the lift arm 62 is rotating, the roller 62*a* at one end portion of the lift arm 62 slides along the rail 64, thereby compensating for a difference or deviation between the locus of the lift arm 62 under rotation and the locus of the pane 2 under movement. The equalizer arms 66, 67 prevent inclination of the rails 64, 69.

Figure 4:
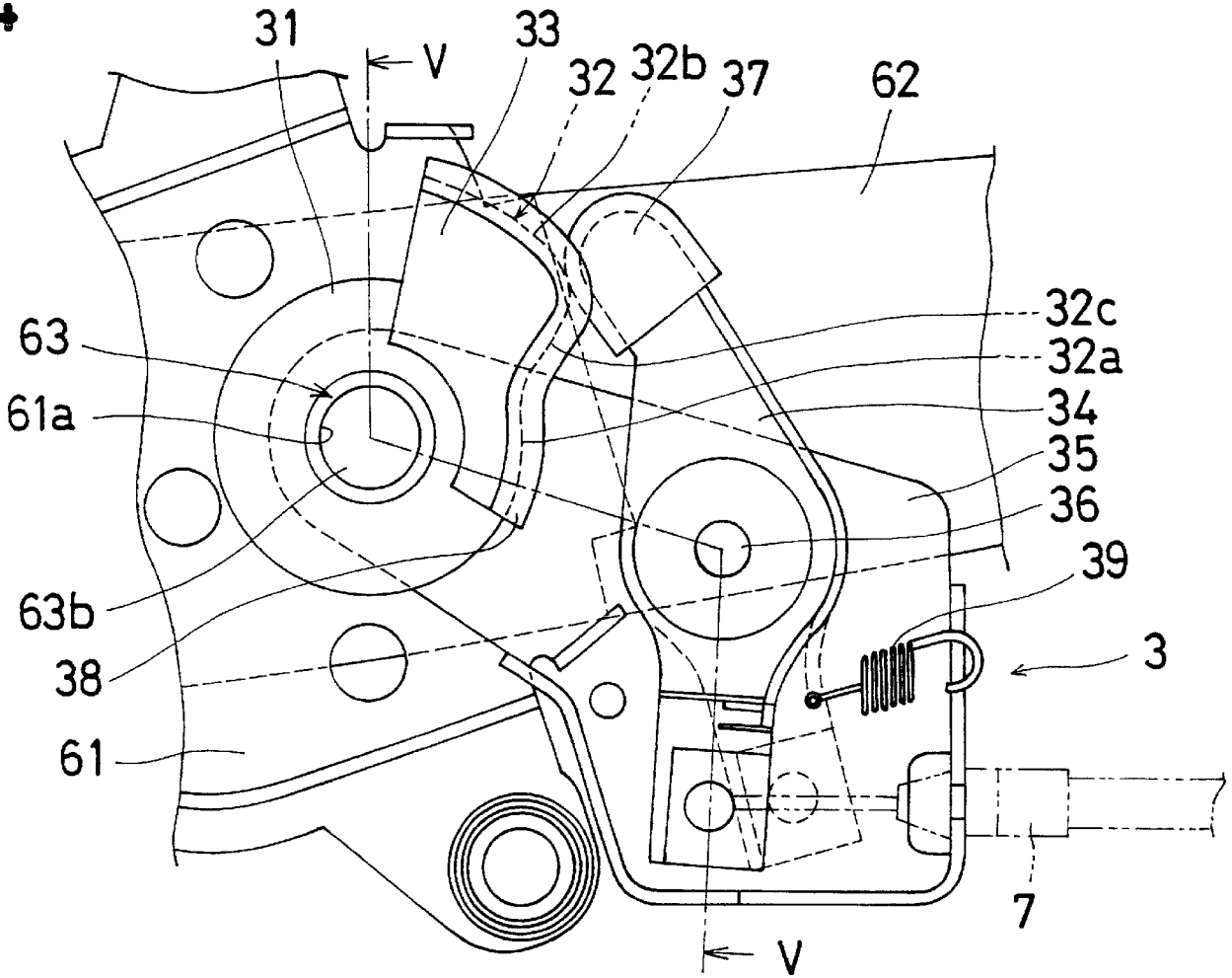
FIG. 4 is a front view of an opening condition detection mechanism that can be used in the window-opening/closing device according to the present invention.
Figure 5:
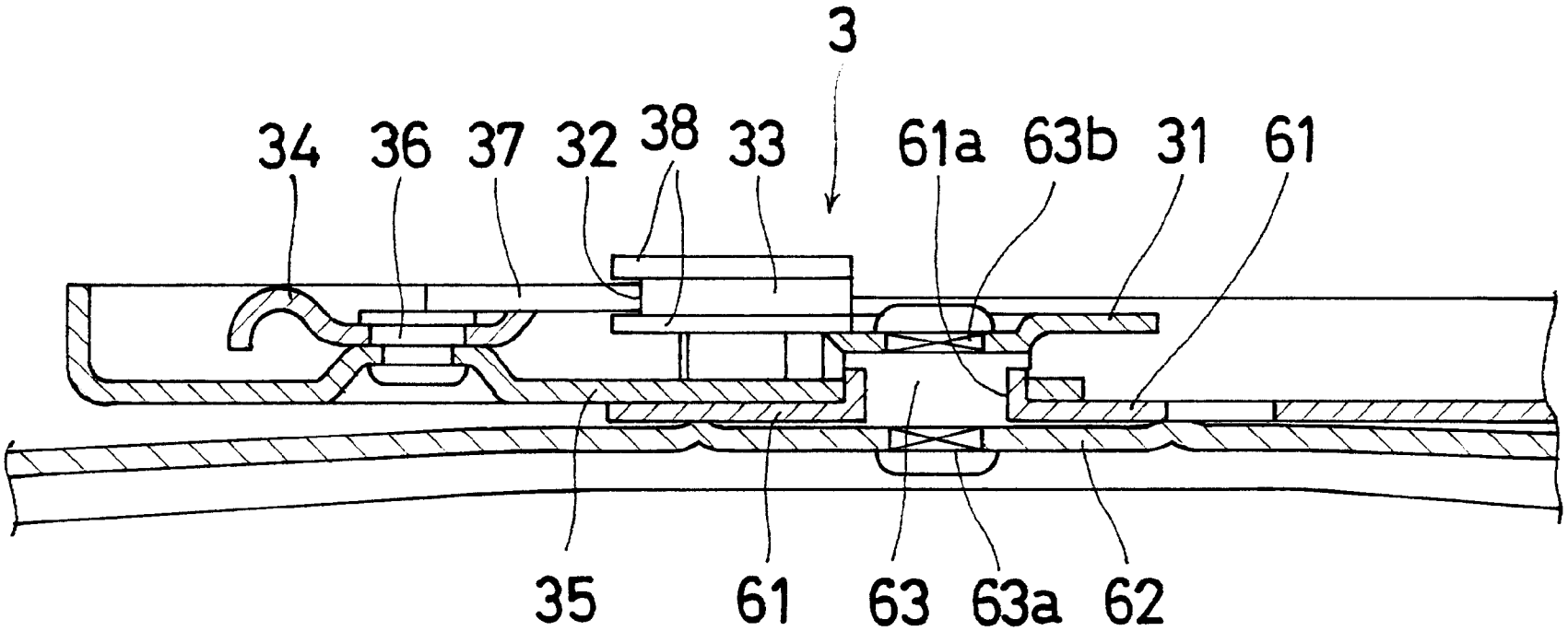
FIG. 5 is a cross-sectional view taken along the section line V—V in FIG. 4.

As shown in FIGS. 4 and 5, the opening condition detection mechanism 3 is unitized in the window regulator mechanism 6 and includes a rotatable member 31 fixed to the shaft 63 and a detection lever 34. The rotatable member 31 is in the form of a cam plate that is secured to the second fixed shaft portion 63*b* of the rotating shaft 63 arranged on the rotational axis of the lift arm 62 that is coincident with the rotating shaft 63 so as to rotate together with the rotating shaft 63. The base plate 61 is arranged between the lift arm 62 and the cam plate 31.

A cam member 33 is fixed on the cam plate 31. The cam member 33 is provided at its outer periphery with a cam surface 32. The cam surface 32 is configured to be substantially sector shaped with respect to the center of the rotational axis of lift arm 62 that is coincident with the rotating shaft 63. The cam surface 32 changes in width in the radial direction (i.e., the distance between the center of the rotational axis about which the cam member 33 rotates and the cam surface 32) so that the cam surface 32 has a larger width portion 32*b*, a smaller width portion 32*a* and a stepped portion 32*c* arranged in the circumferential direction, with the stepped portion 32*c* being disposed between the larger width portion 32*b* and the smaller width portion 32*a*. The cam member 33 can be integrally formed with the cam plate 31.

The detection lever 34 is rotatably supported on a bracket 35 by a pin 36. The bracket 35 is fixed to the base plate 61 at the flange of the through hole 61*a* of the base plate 61. A resin shoe 37 is attached to one distal end of the detection lever 34 and slidably contacts the cam surface 32 of the cam member 33. Spaced apart guide walls 38, 38 are formed on the outer periphery of the cam member 33 on either side of the cam surface 32 so that the cam surface 32 is located between the guide walls 38 as shown in FIG. 5. The guide walls 38, 38 extend radially outwardly and guide the resin shoe 37 relative to the cam surface 32. The other end of the detection lever 34 is connected to the connecting cable 7. A spring 39 is mounted between the detection lever 34 and the bracket 35. The detection lever 34 is rotated or urged in the counter-clockwise direction in FIG. 4 by the biasing force of the spring 39 so that the resin shoe 37 always slidably contacts the cam surface 32.

When the window portion 19 of the slide door 1 is fully closed by the window pane 2 (i.e., the window is in the fully closed position), the cam plate 31 is positioned so that the resin shoe 37 of the detection lever 34 contacts the smaller width portion 32*a* of the cam surface 32 of the cam member 33. If the window regulator 6 is operated to lower the pane 2 for purposes of opening the window portion 19, the lift arm 62 rotates in the clockwise direction in FIG. 3. At the same time, the cam plate 31 rotates with the lift arm 62 through the rotating shaft 63. Therefore, the resin shoe 37 contacts the larger width portion 32*b* of the cam member 33 by riding through the stepped portion 32*c*. The detection lever 34 thus rotates in the clockwise direction from the broken line position shown in FIG. 4 to the solid line position shown in FIG. 4 against the biasing force of the spring 39. As a result, the connecting cable 7 is pulled to initiate the operation of the stopper mechanism 4 as described above. As also mentioned above, the pulling of the connecting cable 7 prevents the slide door 1 from being brought into its fully opened condition.

With the present invention, by virtue of the construction of the vehicle slide door window opening and closing device, the device, including the cam member and cam plate, can be reduced in size.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A device for opening and closing a vehicle slide door window comprising:

a window regulator mechanism including a lift arm supporting a pane and a driving mechanism operatively connected to the lift arm for moving the pane in downward and upward directions when the driving mechanism rotates the lift arm about a rotational axis in opposite directions to effect opening and closing of a window portion;

a shaft fixedly mounted on the drive arm coaxially with respect to the rotational axis for rotation with the lift arm about the rotational axis;

a cam plate fixedly mounted on the shaft for rotating together with the shaft and the lift arm about the rotational axis; and a detection lever positioned adjacent to the cam plate and having an end brought into contact with the cam plate.

2. The device for opening and closing a vehicle slide door window according to claim 1, further including a base plate, the shaft rotatably supported on the base plate.

3. The device for opening and closing a vehicle slide door window according to claim 2, wherein the base plate is arranged between the cam plate and the lift arm in an axial direction of the shaft.

4. The device for opening and closing a vehicle slide door window according to claim 3, wherein the cam plate includes a cam surface, and a guide wall positioned on each side of the cam surface in the axial direction of the shaft.

5. The device according to claim 1 further including a connecting cable connected to the detection lever for movement therewith.

6. The device for opening and closing a vehicle slide door window according to claim 5, wherein the end of the detection lever is positioned between the guide walls.

7. The device for opening and closing a vehicle slide door window according to claim 6, wherein the end of the detection lever which contacts the cam surface is provided with a resin shoe.

8. The device for opening and closing a vehicle slide door window according to claim 1, wherein the driving mechanism is operatively connected to a sector gear provided at one end of the lift arm.

9. A device for opening and closing a vehicle slide door window comprising:

a lift arm supporting a window pane;

a shaft on which the lift arm is mounted for rotating about a rotational axis together with the lift arm;

a driving mechanism operatively associated with the lift arm to rotate the lift arm in opposite directions and cause upward and downward movement of the window pane;

a cam member mounted on the shaft to rotate together with the shaft, the cam member including a cam surface;

a movable detection lever having a portion engaging the cam surface to move in response to rotation of the cam member; and a connecting cable connected to the detection lever to be pulled by the detection lever upon rotation of the detection lever.

10. The device for opening and closing a vehicle slide door window according to claim 9, wherein the shaft is mounted on a base plate.

11. The device for opening and closing a vehicle slide door window according to claim 10, wherein the base plate is positioned between the lift arm and the cam member.

12. The device for opening and closing a vehicle slide door window according to claim 9, wherein the cam member comprises a cam plate, the cam plate including a guide wall positioned on both axial sides of the cam surface.

13. The device for opening and closing a vehicle slide door window according to claim 12, wherein said portion of the detection lever is positioned between the guide walls.

14. The device for opening and closing a vehicle slide door window according to claim 9, wherein said portion of the detection lever is provided with a resin shoe.

15. The device for opening and closing a vehicle slide door window according to claim 9, wherein the driving mechanism is operatively connected to a sector gear provided at one end of the lift arm.

16. A device for opening and closing a vehicle slide door window comprising:

a lift arm supporting a window pane;

a driving mechanism operatively associated with the lift arm to rotate the lift arm about a rotational axis to raise and lower the window pane;

a rotatable member rotatable about said rotational axis; and a movable detection lever engaged with the rotatable member to move in response to rotation of the rotatable member;

wherein the detection lever is connected to a connecting cable that is moved in response to movement of the detection lever.

17. The device for opening and closing a vehicle slide door window according to claim 16, wherein the rotatable member includes a cam surface.

18. The device for opening and closing a vehicle slide door window according to claim 16, wherein the lift arm and the rotatable member are secured to a shaft.

19. The device for opening and closing a vehicle slide door window according to claim 18, wherein the shaft is mounted on a base plate.

20. The device for opening and closing a vehicle slide door window according to claim 19, wherein the base plate is positioned between the lift arm and the movable member.

21. A device for opening and closing a vehicle slide door window comprising:

a window regulator mechanism including a lift arm supporting a pane and a driving mechanism operatively connected to the lift arm for moving the pane in downward and upward directions when the driving mechanism rotates the lift arm about a rotational axis in opposite directions to effect opening and closing of a window portion;

a base plate;

a shaft rotatably supported on the base plate and fixed on the lift arm for rotation therewith, the shaft arranged coaxially with the rotational axis;

a cam plate fixed on the shaft for rotation together with the shaft and the lift arm, the cam plate including a cam surface and guide walls disposed on respective sides of the cam surface, the guide walls spaced apart in the axial direction of the shaft;

the base plate arranged between the cam plate and the lift arm in an axial direction of the shaft; and a detection lever positioned adjacent to the cam plate and having an end brought into contact with the cam surface.

* * * * *